US005992164A

United States Patent [19]

Kim

[11] Patent Number: 5,992,164

[45] Date of Patent: Nov. 30, 1999

[54] APPARATUS FOR AND METHOD OF SUPPLYING COLD AIR IN REFRIGERATORS

[75] Inventor: Seok Ro Kim, Changwon, Rep. of Korea

[73] Assignee: LG Electronics, Inc., Seoul, Rep. of Korea

[21] Appl. No.: 09/095,070

[22] Filed: Jun. 10, 1998

[30] Foreign Application Priority Data

Jun. 12, 1997 [KR] Rep. of Korea ..... 97-24375

[51] Int. Cl.[6] ..... F25D 17/04

[52] U.S. Cl. ..... 62/186; 62/408; 62/426; 62/441

[58] Field of Search ..... 62/186, 187, 408, 62/426, 441

[56] References Cited

U.S. PATENT DOCUMENTS 4,876,860 10/1989 Negishi ..... 62/186 X
5,319,937 6/1994 Fritsch et al. ..... 62/426 X
5,765,388 6/1998 Jeon ..... 62/408
5,784,895 7/1998 Choi ..... 62/441 X
5,809,799 9/1998 Jeon ..... 62/408
5,826,437 10/1998 Kim ..... 62/186

*Primary Examiner*—Henry Bennett
*Assistant Examiner*—Marc Norman
*Attorney, Agent, or Firm*—Birch, Stewart, Kolasch & Birch, LLP

[57] ABSTRACT

An apparatus for and a method of supplying cold air to a refrigeration compartment door passing through a distributing duct provided in the apparatus, are disclosed. A refrigerator with the apparatus includes at least one compartment for preserving foods at a cold temperature, a first duct for supplying cool air to one portion of the compartment, a second duct for supplying the cool air to the other portion of the compartment and a pair of blower fans mounted in order to introduce the cool air to the first and second ducts, respectively. Therefore, the interior of the refrigeration compartment is maintained at a desired low temperature, thus allowing foods in the refrigeration compartment to be always maintained at the desired low temperature.

10 Claims, 4 Drawing Sheets

APPARATUS FOR AND METHOD OF SUPPLYING COLD AIR IN REFRIGERATORS

BACKGROUND OF THE INVENTION

1. Field of the Invention

The present invention relates, in general, to an apparatus for and a method of supplying cold air in a refrigerator and, more particularly, to an apparatus for and a method of supplying cold air to a refrigeration compartment door passing through a distributing duct provided in the apparatus, thus allowing cool air to be simultaneously discharged from both front and rear portions of a refrigeration compartment and effectively uniforming the inner temperature of the refrigeration compartment.

2. Description of the Prior Art

FIGS. 1 and 2 illustrate the construction of a typical refrigerator and a general cool air supply construction applied to the refrigerator construction, respectively.

As shown in the drawings, the interior of the typical refrigerator is divided into two compartments: freezer and refrigeration compartments 2 and 4, by a barrier 5 filled with an insulating material.

Now, the circulation of cool air in the above-mentioned refrigerator will be described below.

As shown in FIG. 2, a liquid refrigerant, having low temperature and low pressure, is quickly vaporized in the evaporator 6 while absorbing heat from air in the interior of the refrigerator, thus forming cool air to be circulated in the interior of the refrigerator. That is, the cool air, generated in accordance with the heat exchange operation around the evaporator 6, is partially discharged into the freezer compartment 2 passing through a shroud 12 by a blower fan 8. At this time, the remaining cool air is also discharged into the refrigeration compartment 4 via a space defined between a grill 13 and the shroud 12 arranged in the rear of the grill 13. That is, the cool air freely flows down into a refrigeration compartment duct 10. Thereafter, the cool air is discharged from the rear portion to the front portion of the refrigeration compartment 4 through a plurality of discharging holes 10*a* which are formed on the front portion of the refrigeration compartment duct 10.

As a result, the cool air, supplied into both freezer and refrigeration compartments 2 and 4, has a relatively high temperature after a time. That is, the low temperature of the cool air is transmitted to food and drink in the freezer and refrigeration compartments 2 and 4, thus forming warm air in both compartments 2 and 4, respectively. Such warm air, circulated through the freezer and refrigeration compartments 2 and 4, returns to the evaporator 6 through first and second return ducts 2*a* and 4*a*, which are provided in the barrier 5.

In this case, the circulation of the cool air is determined by the inner temperature of the freezer compartment 2. That is, the refrigerating cycle of the refrigerator, designed for generating cool air and including the evaporator 6 and a compressor (not shown), etc., operates by the current temperature of the freezer compartment 2. Thus, when the inner temperature of the freezer compartment, sensed by a temperature sensor 3 installed in the freezer compartment 2, is higher than a predetermined temperature, the refrigerating cycle is carried out. On the contrary, when the inner temperature of the freezer compartment is less than the predetermined temperature, the driving of the refrigerating cycle is stopped. Alternatively, the driving of the refrigerating cycle may be carried out by the inner temperature of the refrigeration compartment 4.

However, the typical refrigerator is problematic in that it is somewhat difficult for the cool air to be suitably supplied to the refrigeration compartment due to the supplying of the cool air to the freezer compartment.

In addition, it is difficult to evenly maintain the inner temperature of the refrigeration compartment because the cool air is only discharged from the rear portion to the front portion of the refrigeration compartment through the discharging holes 10*a*.

Furthermore, the temperature of the inside portion of the refrigeration compartment 4 is higher than that of a portion around the door of the refrigeration compartment 4. Particularly, when the door of the refrigeration compartment 4 is repeatedly opened and closed, the temperature around the door portion of the refrigeration compartment 4 rises because hot air is introduced from the surroundings into the refrigeration compartment 4. Therefore, it is difficult for the refrigerator to maintain the freshness of the food and drink in baskets 14 of the refrigeration compartment door.

SUMMARY OF THE INVENTION

Accordingly, in light of the above problems occurring in the prior art, an object of the present invention is to provide an apparatus capable of uniforming the inner temperature of a refrigeration compartment, thus achieving the improved refrigerating effect of a refrigerator.

Another object of this invention is to provide an apparatus capable of effectively supplying cool air to the front portion of a refrigeration compartment door, which may easily experience a relatively high temperature as the door is repeatedly opened and closed.

A further object of this invention is to provide a method of supplying cold air capable of allowing the freezer and refrigeration compartments to be always maintained at a desired set temperature.

Yet another object of this invention is to provide a method of supplying cool air capable of discharging the cool air to a refrigeration compartment door.

In order to accomplish the above objects, the present invention provides a refrigerator, comprising: at least one compartment for preserving foods at a cold temperature; a first duct for supplying cool air to one portion of the compartment; a second duct for supplying the cool air to the other portion of the compartment; and a pair of blower fans mounted in order to introduce the cool air to the first and second ducts, respectively.

In the refrigerator, an outlet of the first duct is formed on a rear portion of the compartment, and an outlet of the second duct is formed on a front portion of the compartment.

In addition, a door duct is mounted on an inner surface of a door of the refrigerator in order to communicate with the outlet of the second duct after closing the door, so the cool air is discharged to a rear portion of a refrigeration compartment passing through the door duct.

The second duct is provided in an interior of a side wall of the refrigerator, the side wall is filled with an insulating material.

The refrigerator is divided into freezer and refrigeration compartments by a barrier, the second duct extends to a front portion of the refrigeration compartment passing through the barrier.

Furthermore, a damper is provided in an interior of the second duct in order to adjust the flowing of the cool air, the damper is selectively operated according to a temperature sensed by a sensor mounted to the door portion of the refrigerator.

In another embodiment, the present invention provides a method for supplying cold air in a refrigerator including a first duct adapted to supply the cool air to both the freezer compartment and the rear portion of a refrigeration compartment, and a second duct designed for supplying the cool air to a front portion of the refrigeration compartment, comprising the steps of: sensing respective temperatures of the front and rear portions of the refrigeration compartment; comparing the sensed temperatures of the front and rear portions of the refrigeration compartment with associated set temperatures, respectively; and when at least one of the sensed temperatures is higher than an associated set temperature, concentratedly supplying cool air to the compartment portion exhibiting the temperature higher than the set temperature, so the cool air is separately introduced into the front portion of the refrigeration compartment according to a temperature of the front portion of the refrigeration compartment.

Further scope of applicability of the present invention will become apparent from the detailed description given hereinafter. However, it should be understood that the detailed description and specific examples, while indicating preferred embodiments of the invention, are given by war of illustration only, since various changes and modifications within the spirit and scope of the invention will become apparent to those skilled in the art from this detailed description.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

FIGS. 3 to 7 are views illustrating the construction of a refrigerator and a cold air supply construction applied to the refrigerator construction in accordance with the preferred embodiment of the present invention.

Figure 1:
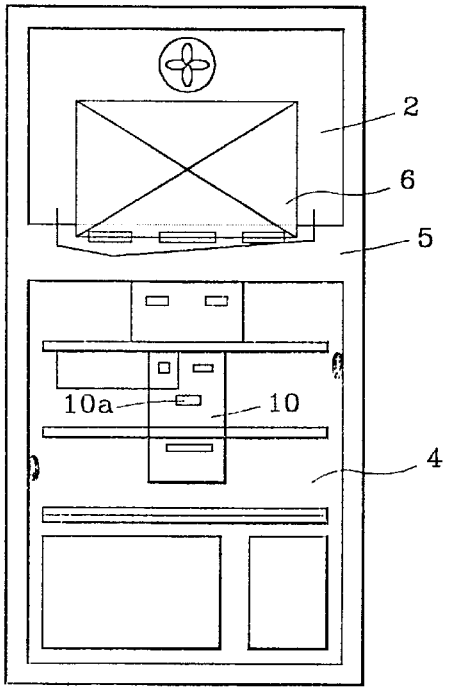
FIG. 1 is a front view illustrating the construction of a typical refrigerator.
Figure 2:
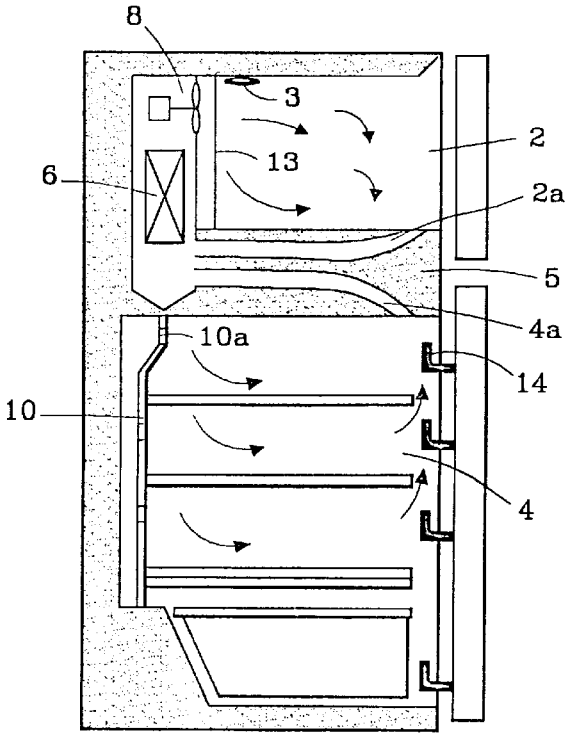
FIG. 2 is a sectional side view showing the refrigerator of FIG. 1.
Figure 3:
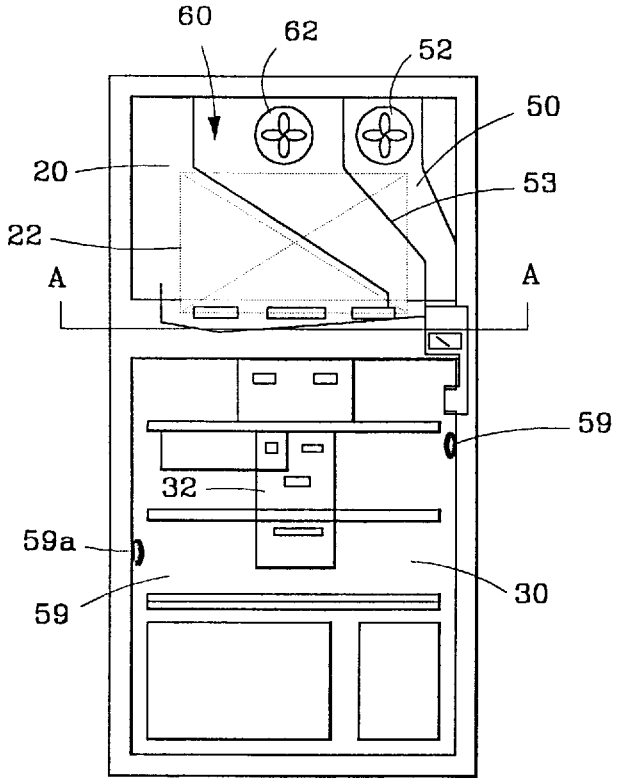
FIG. 3 is a front view illustrating the construction of a refrigerator in accordance with the preferred embodiment of the present invention.

As shown in FIG. 3, the refrigerator includes first and second ducts 60 and 50. That is, the first duct 60 is mounted above an evaporator 22 in order to supply cool air, generated according to the heat exchange operation around the evaporator 22, to freezer and refrigeration compartments 20 and 30 at the same time. Also, the second duct 50 is disposed at the side of the first duct 60 in order to directly introduce the cool air into the front portion of the refrigeration compartment 30. In the preferred embodiment, the first duct 60 is integrally formed to the second duct 50 but the first and second ducts 60 and 50 are separated by a partition 53. Also, a pair of blower fans 62 and 52, designed for supplying the cool air, are mounted to the first and second ducts 60 and 50, respectively.

That is, the cool air, generated around the evaporator 22, is partially discharged to both freezer and refrigeration compartments 20 and 30 by the first blower fan 62. At this time, the cool air is partially introduced into a distributing duct 54 by the second blower fan 52 disposed at the right side of the first blower fan 52. Such first and second blower fans 62 and 52 are simultaneously operated. Alternatively, one of the first and second blower fans 62 and 52 may be operated by the inner temperature of the refrigeration compartment, as will described hereinafter.

The cool air is introduced into a refrigeration compartment duct 32, provided in the rear portion of the refrigeration compartment 30, passing through the first duct 60 by the first blower fan 62. Thus, the cool air is discharged from the rear portion to the front portion of the refrigeration compartment 30. In addition, the cool air is introduced into the distributing duct 54 passing through the second duct 50 by the second blower fan 52 as shown in FIG. 4.

Figure 4:
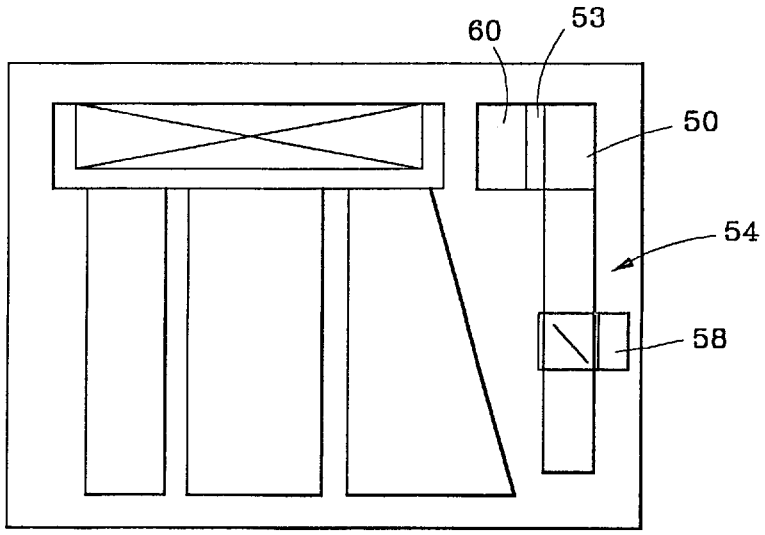
FIG. 4 is a cross-sectional view taken along the line A—A of FIG. 3.
Figure 5:
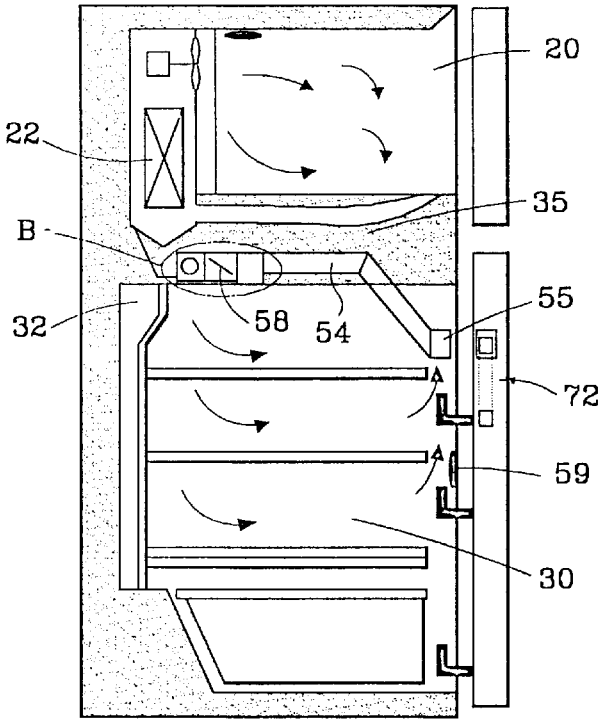
FIG. 5 is a sectional side view illustrating the refrigerator of FIG. 3.

With reference to FIGS. 4 and 5, the construction of the distributing duct 54 will be described below.

The distributing duct 54, communicating with the second duct 50, is provided in a barrier 35, which is formed between the freezer and refrigeration compartments 20 and 30. Also, an outlet 55 of the distributing duct 54 extends to the front portion of the refrigeration compartment 30. When, the distributing duct 54 includes a duct, capable of guiding the cool air of the second duct 50 to the outlet 55 formed to the front portion of the refrigeration compartment 30, it is possible for the distributing duct 54 to be passed through the barrier 35 or any portion of the side wall of the refrigeration compartment 30.

Now, the construction of a door duct 72, designed for guiding the cool air of the distributing duct 54, is described hereinafter.

Figure 6:
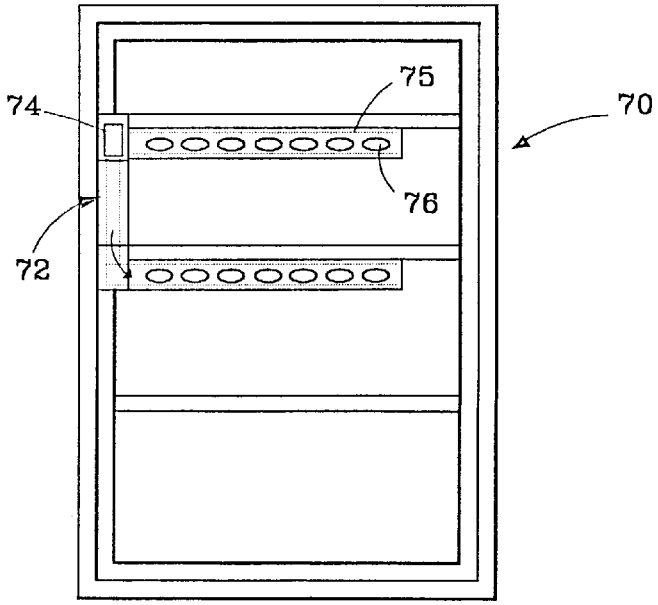
FIG. 6 is a front view of a refrigeration compartment door of the refrigerator of FIG. 3.

FIG. 6 is a front view illustrating a refrigeration compartment door of the refrigerator in accordance with the preferred embodiment of the present invention.

As shown in FIG. 6, the door duct 72 is mounted on the inner surface of a door 70 of the refrigeration compartment 30. The inlet 74 of the door duct 72 is formed in order to communicate with the outlet 55 of the distributing duct 54 after closing the door 70. Thus, the cool air of the door duct 72 is introduced into horizontal ducts 75 and is discharged into the refrigeration compartment 30 passing through a plurality of discharging holes 76 formed on the horizontal ducts 75. As a result, the cool air is discharged from the door 70 to the inside of the refrigeration compartment 30.

Figure 7:
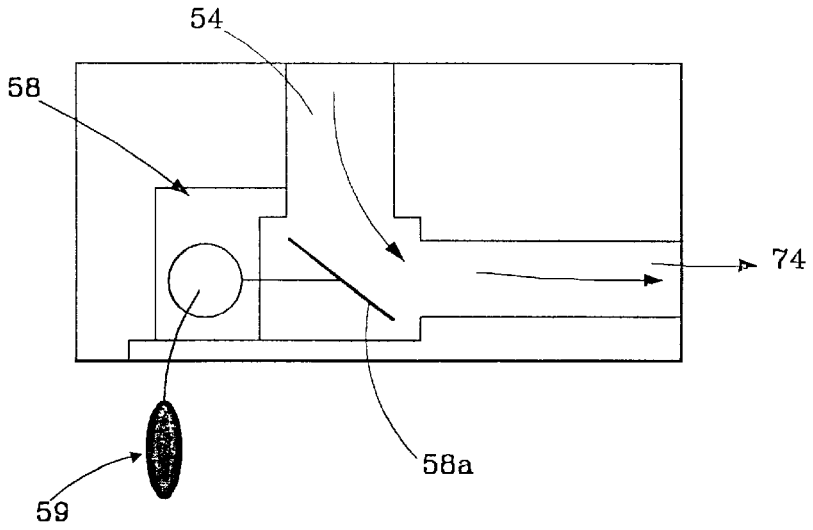
FIG. 7 is an expanded sectional view of "B" illustrated in FIG. 5.

As shown in FIGS. 5 to 7, an adjusting device 58 is mounted to the distributing duct 54, thereby effectively adjusting the flowing of the cool air of the distributing duct 54. It is possible to use a typical adjusting device in place of the above adjusting device 58. That is, the typical adjusting device can be manually operated by a user. Alternatively, the typical adjusting device may be automatically operated by the inner temperature of the refrigeration compartment.

In the preferred embodiment of this invention, the adjusting device 58 includes a rotatable plate 58*a* capable of being operated by a motor (not shown). Thus, the distributing duct is selectively closed or opened by the operation of the rotatable plate 58*a*. The adjusting device 58 is operated by the inner temperature of the refrigeration compartment 30, concretely, based on a temperature around the refrigeration compartment door 70. That is, when a temperature, sensed by a temperature sensor 59 mounted to the door 70 of the refrigeration compartment 30, is higher than the predetermined temperature of the refrigeration compartment 30, the distributing duct 54 is opened by the adjusting device 58.

The adjusting device 58, mounted to the distributing duct 54 is different from an adjusting device (not shown), which is mounted to the refrigeration compartment duct 32 and is designed for controlling the cool air discharging into refrigeration compartment 30.

A cool air supplying method carried out using the cool air supplying apparatus according to the above-mentioned embodiment of this invention will be described in conjunction with FIG. 8.

Figure 8:
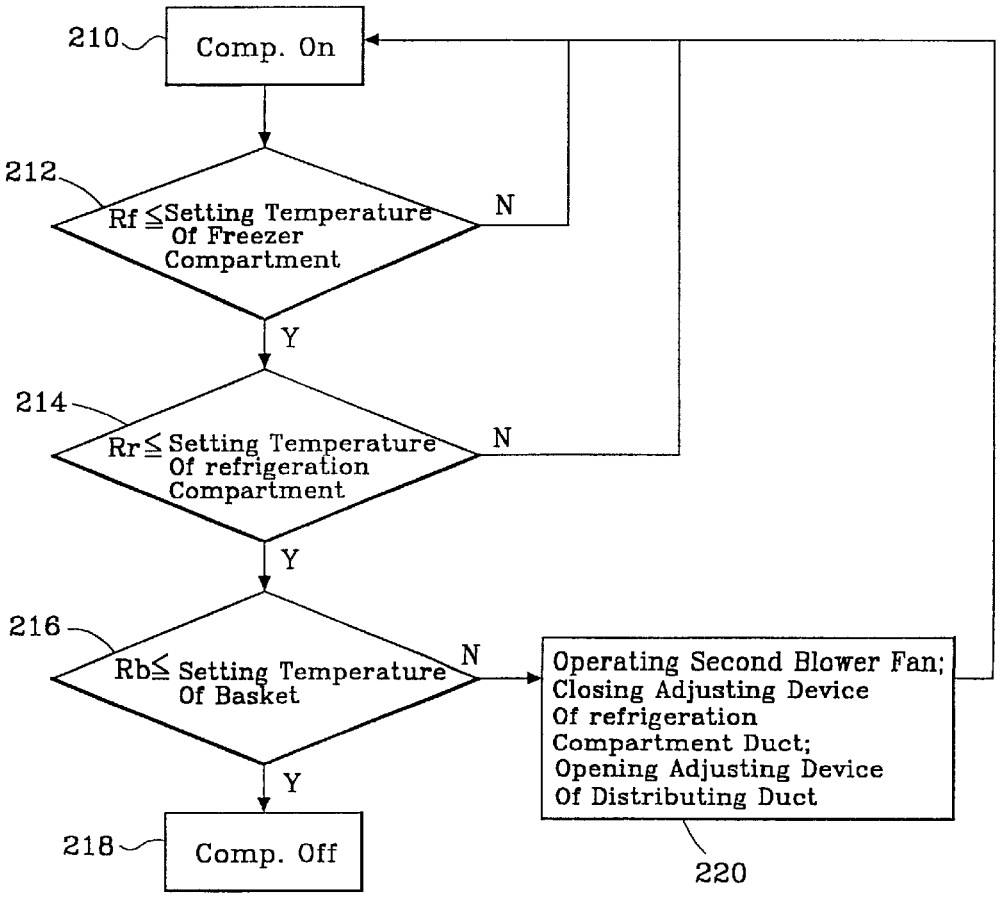
FIG. 8 is a flow chart illustrating a temperature controlling method in accordance with the present invention.

FIG. 8 is a flow chart illustrating a temperature controlling method in accordance with the present invention and only illustrates the operational procedure of a compressor designed for driving a refrigerating cycle.

That is, when it is necessary for the cool air to be circulated through the interior of the refrigerator, the driving of the refrigerating cycle is carried out by the driving of the compressor.

In the preferred embodiment of this invention, a plurality of sensors are mounted in the interiors of the freezer and refrigeration compartments, respectively. Thus, when at least one of the temperatures sensed by the sensors is less than the predetermined temperature, the driving of the refrigerating cycle for the refrigerator is carried out during the driving of the refrigerator.

In a brief description, it is primarily determined at step 212 whether or not the current temperature Rf of the freezer compartment 20 is higher than the set temperature during the driving of the refrigerator. When the current temperature Rf of the freezer compartment 20 is higher than the set temperature, the driving of the refrigerating cycle is carried out at step 210 in order to supply the cool air. In such a case, since the cool air is concentratedly discharged into the freezer compartment 20, it is preferable to operate only the first blower fan 62. Alternatively, the cool air may be simultaneously discharged into the freezer and refrigeration compartments 20 and 30 by the blower fans 62 and 52, respectively. When the current temperature Rf of the freezer compartment 20 is similar to the set temperature, it is determined at step 214 whether or not the current temperature Rr of the refrigeration compartment 30 is less than the set temperature. The above current temperature Rr is an optional temperature of the interior of the refrigeration compartment 30, for example, a temperature sensed by the temperature sensor 59*a* illustrated in FIG. 3. Thus, when the inner temperature of the refrigeration compartment 30 is higher than the set temperature, the driving of the refrigerating cycle is carried out at step 210, thereby supplying the cool air. In this case, when the cool air is discharged, the first and second blower fans 62 and 52, mounted above the evaporator 22, are operated at the same time. Thus, the cool air is discharged from the front and rear portions of the refrigeration compartment 30. At this time, when the temperature around the refrigeration compartment door 70 is similar to the set temperature, the operation of the second blower fan 52 or the adjusting device 58 mounted to the distributing duct 54 is stopped, thereby causing the flowing of the cool air to be stopped.

When the temperature, sensed by the temperature sensor 59*a*, is less than the set temperature, it is determined at step 216 whether or not the current temperature Rb around the refrigeration compartment door 70 is higher than the set temperature. The current temperature around the refrigeration compartment door 70 is a temperature, which is sensed from a portion which may easily experience a relatively high temperature in the refrigeration compartment 30. Thus, when the temperature Rb around the door 70 is higher than the set temperature, the driving of the refrigerating cycle is carried out in order to supply the cool air. In step 216, when the rear temperature of the refrigeration compartment 30 (sensed by the temperature sensor 59*a*) is similar to the set temperature but the front temperature of the refrigeration compartment 30 (sensed by the temperature sensor 59) is higher than the set temperature, it is preferable to only operate the second blower fan 52. At this time, the distributing duct 54 has to be maintained in an opened state by the adjusting device 58. When the current temperature Rb around the refrigeration compartment door 70 is less than the set temperature, the driving of the refrigerating cycle is stopped at step 218.

In the temperature controlling method in accordance with this invention, the inner temperatures of the freezer and refrigeration compartments are primarily compared to their set temperatures, respectively. Thereafter, when at least one of the inner temperatures of the freezer and refrigeration compartments is higher than their set temperature, the driving of the refrigerating cycle is carried out in order to supply the cool air. Also, it is possible to allow the cool air to be concentratedly discharged into the refrigeration compartment door, thus effectively refrigerating a portion which may easily experience a relatively high temperature in the refrigeration compartment.

In the apparatus for supplying the cold air according to the present invention, the first and second ducts 60 and 50 are provided in the interior of the refrigerator in order to supply the cool air, generated around the evaporator, to the door duct 72. Since the cool air is only discharged into the door duct 72 by means of the second duct 50, it is possible for the cool air to be directly introduced into the door duct 72. In addition, the separated blower fan 52 is mounted near the second duct 50, thereby quickly supplying the cool air. The cool air is simultaneously discharged from both front and rear portions of the refrigeration compartment 30 to its central portion. In particular, the cool air, having a relatively low temperature and generated in accordance with the heat exchange operation around the evaporator, is quickly introduced into the door duct. Therefore, the front portion of the refrigeration compartment, which may easily experience a relatively high temperature as the door is repeatedly opened and closed, is maintained at a desired low temperature.

In the cool air supplying method carried out using the cool air supplying apparatus according to this invention, a plurality of sensors are mounted in the refrigeration compartment in order to sense the current temperature of the refrigeration compartment. Thus, when at least one of the temperatures sensed by the sensors is, less than the predetermined temperature, the driving of the refrigerating cycle for the refrigerator is carried out in order to supply the cool air. Particularly, when the inner temperature of the refrigeration compartment rises, the cool air is quickly discharged into the refrigeration compartment by supplying the cool air. In addition, since the sensor is mounted at a portion which may easily experience a relatively high temperature in the refrigeration compartment, the inner temperature of the refrigeration compartment is maintained at a desired low temperature.

Furthermore, the supplying apparatus is provided with the distributing duct, for introducing the cool air to the door, and the adjusting device mounted to the distributing duct in order to effectively control the flowing of the cool air of the distributing duct. Thus, the temperature around baskets mounted to the door is maintained at a desired low temperature. At this time, even when the basket portion of the door is excessively refrigerated, the distributing duct is effectively closed by the adjusting device, thus causing the cool air to not be introduced into the door duct.

As mentioned above, the refrigerator of this invention is provided with a cool air supplying apparatus capable of selectively guiding cool air to the basket portion of the refrigeration compartment door, thus uniforming the inner temperature of the refrigeration compartment at a desired low temperature and allowing foods in the refrigeration compartment to be maintained at the desired low temperature.

Although the preferred embodiment;; of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerator, comprising:

at least one compartment for preserving foods at a cold temperature;

a first duct for supplying cool air to one portion of said compartment;

a second duct for supplying the cool air to the other portion of said compartment;

a damper provided in an interior of said second duct, said damper being adjustable according to a sensed temperature; and a pair of blower fans mounted in order to introduce the cool air to said first and second ducts, respectively.

2. The refrigerator as claimed in claim 1, wherein an outlet of said first duct is formed on a rear portion of said compartment, and an outlet of said second duct is formed on a front portion of said compartment.

3. The refrigerator as claimed in claim 2, wherein a door duct is mounted on an inner surface of a door of the refrigerator in order to communicate with the outlet of said second duct after closing the door, so the cool air is discharged to a rear portion of a refrigeration compartment passing through said door duct.

4. The refrigerator as claimed in any one of claims 1 to 3, wherein said second duct is provided in an interior of a side wall of the refrigerator, said side wall is filled with an insulating material.

5. The refrigerator as claimed in any one of claims 1 to 3, wherein said refrigerator is divided into freezer and refrigeration compartments by a barrier, said second duct extends to a front portion of said refrigeration compartment passing through said barrier.

6. The refrigerator as claimed in claim 5, wherein said damper provided in said interior of said second duct adjusts the flowing of the cool air, said damper being selectively operated according to a temperature sensed by a sensor mounted to the door portion of said refrigerator.

7. The refrigerator as claimed in claim 1, wherein said pair of blower fans are operative simultaneously, or alternatively operative as separate units.

8. The refrigerator as claimed in claim 7, wherein one of said pair of blower fans is operative at least when a temperature of a rear portion of a refrigeration compartment or a temperature of a freezer compartment is above a predetermined threshold value.

9. The refrigerator as claimed in claim 8, wherein another of said pair of blower fans is operative at least when a temperature of a front portion is above a predetermined threshold value.

10. The refrigerator as claimed in claim 9, wherein said pair of blower fans are at least simultaneously operative when said temperature of the front portion of said refrigeration compartment and said temperature of said rear portion of said refrigeration compartment or temperature of said freezer compartment are both above said predetermined threshold value.

* * * * *